US006339687B1

(12) United States Patent
Ishii

(10) Patent No.: US 6,339,687 B1
(45) Date of Patent: Jan. 15, 2002

(54) DEVELOPING METHOD

(75) Inventor: Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/692,183

(22) Filed: Oct. 20, 2000

(30) Foreign Application Priority Data

Oct. 22, 1999 (JP) ..... 11-300472

(51) Int. Cl.[7] ..... G03G 15/00; G03G 15/08
(52) U.S. Cl. ..... 399/53; 430/120
(58) Field of Search ..... 399/53, 55, 56, 399/50, 130; 347/129, 131; 430/120, 31

(56) References Cited

U.S. PATENT DOCUMENTS

| | | | | |
|---|---|---|---|---|
| 5,252,415 A | * | 10/1993 | Yoshizawa et al. | 430/31 |
| 5,325,122 A | * | 6/1994 | Hattori et al. | 347/131 |
| 5,774,762 A | * | 6/1998 | Yakemoto et al. | 399/50 |
| 5,822,650 A | * | 10/1998 | Noda et al. | 399/53 |
| 6,026,266 A | | 2/2000 | Sakai et al. | |
| 6,049,689 A | | 4/2000 | Ishii et al. | |
| 6,094,550 A | | 7/2000 | Kido et al. | |

FOREIGN PATENT DOCUMENTS

| | | |
|---|---|---|
| JP | 6-095486 A | 4/1994 |
| JP | 7-9552 B2 | 2/1995 |
| JP | 7-31452 B2 | 4/1995 |
| JP | 7-31453 B2 | 4/1995 |
| JP | 7-38093 B2 | 4/1995 |

OTHER PUBLICATIONS

T. Miyasaka, "A Study in the Resolution Characteristics of a Photosensitive United Based on Analysis of anElectrosttic Latent Image," Electronic Photograph Academy Magazine, vol. 30, No. 4, 1991, pp. 432–438 (English abstract on p. 432).

M. Hosoya et al., "A Contact Type Component NonMagnetic Development System (I)", Electronic Photograph Academy Magazine, vol. 31, No. 4, 1992, pp. 531–541 (English abstract on p. 531).

* cited by examiner

*Primary Examiner*—Joan Pendegrass

(57) ABSTRACT

When Cp ($F/m^2$) represents an electrostatic capacity of an image support, Rs (Ω) represents a surface resistance, t (sec) represents a moving time from an electrostatic latent image formation area to a development completion area, Vo (V) represents a potential of a non-image portion of an electrostatic latent image in an image area at the time of forming the electrostatic latent image, Vth (V) represents a surface voltage of the image support when a developing member starts a development at a saturated latent image potential in a solid image, W (m) represents a desired minimum image width, and V1 (V) represents a marginal latent image potential in the minimum image width, and when $$V1=(0.348\ Wr^2-1.161\ Wr+1.0163)\ Vo,$$

and $$Wr=(1/3.63)\cdot(Rs\cdot Cp/t)^{1/2}\cdot W.$$

the following relationship is set:

$$abs(V1)<abs(Vth)$$

where abs (X) represents an absolute value of X.

18 Claims, 10 Drawing Sheets

DEVELOPING METHOD

BACKGROUND OF THE INVENTION

1. Field of the Invention

The present invention relates to a developing method for developing an electrostatic latent image on an image support into a visible image, in an image-formation apparatus of an electronic photographing system.

2. Description of the Prior Art (Prior Art 1)

A photosensitive unit as an image support on which an electrostatic latent image is formed can be expressed by a model consisting of a resistance component ΔRv and a capacity component ΔCp in a thickness direction respectively and a resistance component ΔRs in a surface direction as shown by an equivalent circuit in FIG. 2. Therefore, if the resistance component ΔRs is sufficiently high, an electric charge accumulated in the capacity component ΔCp, that is, an electrostatic latent image, can be held during a period between finish of an exposure and finish of a development. However, when the resistance component ΔRs has become lower due to an adhesion of a stain or the like, the electric charge accumulated in the capacity component ΔCp is lost. As a result, it becomes impossible to obtain a desired resolution.

This state is shown in FIG. 3. FIG. 3 shows one example of a diffusion along a lapse of time of an electrostatic latent image that has been formed with an edge located at a position of x=0. It can be understood from FIG. 3 that there occurs a leakage of an electric charge in the surface direction and the electrostatic latent image changes along with a lapse of time.

As a publication that introduces a prior art of investigation carried out into the resolution of a photosensitive unit from the viewpoint of a change in the electrostatic latent image due to a diffusion of an electric charge along with the lapse of time, there is "A study in the resolution characteristics of a photosensitive unit based on analysis of an electrostatic latent image", Electronic Photograph Academy Magazine, Volume 30, No. 4, 1991, pp. 432–438. This publication reports on a result of a simulation carried out for the deterioration in the resolution of an electrostatic latent image along with a lapse of time based on an electrostatic capacity of a photosensitive unit and a resistance of a charged member. A potential change on a photosensitive unit is expressed by the following.

$$(\delta V/\delta t)=(1/(Rs\cdot Cp))\cdot(\delta V^2/\delta x^2)-V/(Rv\cdot d\cdot Cp) \quad (1)$$

A general solution of this expression is given as follows.

$$V=Vs(x,\ t)\cdot\exp(-t/(Rv\cdot d\cdot Cp)) \quad (2)$$

Further, an edge width W of a one-dimensional electrostatic latent image is given as follows.

$$W=3.55(t/(Cp\cdot Rs))^{1/2} \quad (3)$$

(Prior Art 2)

Various results of investigations have been announced that model a development area and express development characteristics by a numerical equation in an attempt to optimize the development characteristics that are determined based on a combination of a potential of a photosensitive unit, a thickness of a toner layer, a toner charge volume, a resistance of a developing roller, a development bias, etc. As a representative prior art of this trial, there is "A contact type component nonmagnetic development system (1)", Electronic Photograph Academy Magazine, Volume 31, No. 4, 1992, pp. 531–541. According to this method, the electric field of the development area is obtained from a Poisson equation, and a development equation and a simulation result are reported. As a development equation in the case of using a semiconductive developing roller, the following expression is shown.

$$m_{si}=(1/A)\cdot(m_c+k\cdot m_o/A)\cdot(qp/q)\cdot R1)/(1+(1/(A\cdot k)\cdot R_1)) \quad (4)$$

where $$A=dp/\in p+dt/\in t \quad (5)$$

$$m_c=(1/A)\cdot(-(V_o-V_b)/q+(k\cdot m_o/2)\cdot(dt/\in t)) \quad (6)$$

The prior art 1 is based on a simulation that assumes that the development potential is at an intermediate point between the potential of an unexposed portion (VH in the case of an inversion development) and the potential of an exposed portion (VL in the case of an inversion development). The prior art 1 has no disclosure about a correlation with an optional latent image potential. Therefore, there is a problem in that it is not possible to understand a resolution at an optional latent image potential based on an actual using state, such as a development potential at which a highest resolution can be obtained leaving the characteristics of a photosensitive unit as it is, or a development potential that can guarantee the initial performance despite adhesion of stain.

According to the prior art 2, a development current that flows based on the charge qp generated by a frictional charging of a development nip portion is treated with too much emphasis. Further, there is a problem in that no consideration has been taken into the resistance at the photosensitive unit side.

SUMMARY OF THE INVENTION

In the light of the above problems, it is, therefore, an object of the present invention to provide a developing method capable of realizing a satisfactory image quality in high resolution, based on a setting of a development condition that takes into account the charge diffusion of a latent image due to a surface resistance of an image support.

In order to achieve the above object, the present invention is configured as follows:

In accordance with the first aspect of the present invention, a developing method for developing an electrostatic latent image formed on an image support, by an inversion development is characterized in setting the following relationship:

$$abs(V1)<abs(Vth)$$

where abs (X) represents an absolute value of X, when $$V1=(0.348\ Wr^2-1.161\ Wr+1.0163)\ Vo,$$

and $$Wr=(1/3.63)\cdot(Rs\cdot Cp/t)^{1/2}\cdot W,$$

where

Cp ($F/m^2$) represents an electrostatic capacity of an image support, Rs (Ω) represents a surface resistance, t (sec) represents a moving time from an electrostatic latent image formation area to a development completion area, Vo (V) represents a potential of a non-image portion of an electrostatic latent image in an image area at the time of forming the electrostatic latent image, Vth (V) represents a surface voltage of the image support when a developing member starts a development at a saturated latent image potential in a solid image, W (m) represents a desired minimum image width, and V1 (V) represents a marginal latent image potential in the minimum image width.

In accordance with the second aspect of the present invention, the developing method having the above first aspect is further characterized in setting the following relationship:

$$abs(V1')<abs(Vth)$$

when $$V1'=V1\cdot\exp(-t/(Rv\cdot Cp))$$

where

Rv ($\Omega\cdot m^2$) represents a resistance of the image support in a thickness direction.

In accordance with the third aspect of the present invention, the developing method having the above first aspect is further characterized in that, when a toner layer is formed on the surface of the developing member that is applied with a bias voltage Vb (V), and when this developing member is brought into a sliding contact with the image support by a development nip of a predetermined width, values of the following parameters are adjusted to satisfy the following relationship:

$$(-V1+n\cdot Vt+Vb)/\rho d>0$$

where

ρd represents a charge density of the toner layer immediately after the image support passes through the development nip, Vt (V) represents a potential of the toner layer on the developing member, Rr ($\Omega\cdot m^2$) represents a resistance of the developing member, and n represents a ratio (vb/vp) of a rotational speed vb (m/sec) of the developing member to a rotational speed vp (m/sec) of the image support.

In accordance with the fourth aspect of the present invention, the developing method having the above third aspect is further characterized in that values of the following parameters are adjusted to satisfy the following relationship:

$$(-(V1+dV)+n\cdot Vt+Vb)/\rho d>0$$

where dV (V) represents a variation in the surface potential of the image support due to a friction with the toner when the surface of the image support passes through the development nip.

In accordance with the fifth aspect of the present invention, the developing method having the above second aspect is further characterized that, when a toner layer is formed on the surface of the developing member that is applied with a bias voltage Vb (V), and when this developing member is brought into a sliding contact with the image support by a development nip of a predetermined width, values of the following parameters are adjusted to satisfy the following relationship:

$$(-V1'+n\cdot Vt+Vb)/\rho d>0$$

where

ρd represents a charge density of the toner layer immediately after the image support passes through the development nip, Vt (V) represents a potential of the toner layer on the developing member, Rr ($\Omega\cdot m^2$) represents a resistance of the developing member, and n represents a ratio (vb/vp) of a rotational speed vb (m/sec) of the developing member to a rotational speed vp (m/sec) of the image support.

In accordance with the sixth aspect of the present invention, the developing method having the above fifth aspect is further characterized in that values of the following parameters are adjusted to satisfy the following relationship:

$$(-(V1'+dV)+n\cdot Vt+Vb)/\rho d>0$$

where dV (V) represents a variation in the surface potential of the image support due to a friction with the toner when the surface of the image support passes through the development nip.

In accordance with the seventh aspect of the present invention, a developing method for developing an electrostatic latent image formed on an image support by a positive development is characterized in setting the following relationship:

$$abs(V2)<abs(Vth)$$

where abs (X) represents an absolute value of X, when $$V2=(-0.348\ Wr^2+1.161\ Wr-0.0163))Vo,$$

and $$Wr=(1/3.63)\cdot(Rs\cdot Cp/t)^{1/2}\cdot W,$$

where

Cp ($F/m^2$) represents an electrostatic capacity of an image support, Rs ($\Omega$) represents a surface resistance, t (sec) represents a moving time from an electrostatic latent image formation area to a development completion area, Vo (V) represents a potential of a non-image portion of an electrostatic latent image in an image area at the time of forming the electrostatic latent image, Vth (V) represents a surface voltage of the image support when a developing member starts a development at a saturated latent image potential in a solid image, W (m) represents a desired minimum image width, and V2 (V) represents a marginal latent image potential in the minimum image width.

In accordance with the an eighth aspect of the present invention, the developing method having the above seventh aspect is further characterized in setting the following relationship:

$$abs(V2')<abs(Vth)$$

when $$V2'=V2\cdot\exp(-t/(Rv\cdot Cp))$$

where

Rv ($\Omega\cdot m^2$) represents a resistance of the image support in a thickness direction.

In accordance with the a ninth aspect of the present invention, the developing method having the above seventh aspect is further characterized in that, when a toner layer is formed on the surface of the developing member that is applied with a bias voltage Vb (V), and when this developing member is brought into a sliding contact with the image support by a development nip of a predetermined width, values of the following parameters are adjusted to satisfy the following relationship:

$$(-V2+n\cdot Vt+Vb)/\rho d>0$$

where

ρd represents a charge density of the toner layer immediately after the image support passes through the development nip, Vt (V) represents a potential of the toner layer on the developing member, Rr ($\Omega\cdot m^2$) represents a resistance of the developing member, and n represents a ratio (vb/vp) of a rotational speed vb (m/sec) of the developing member to a rotational speed vp (m/sec) of the image support.

In accordance with the tenth aspect of the present invention, the developing method having the above ninth aspect is further characterized in that values of the following parameters are adjusted to satisfy the following relationship:

$$(-(V2+dV)+n\cdot Vt+Vb)/\rho d>0$$

where dV (V) represents a variation in the surface potential of the image support due to a friction with the toner when the surface of the image support passes through the development nip.

In accordance with the eleventh aspect of the present invention, the developing method having the above eighth aspect is further characterized in that when a toner layer is formed on the surface of the developing member that is applied with a bias voltage Vb (V), and when this developing member is brought into a sliding contact with the image support by a development nip of a predetermined width, values of the following parameters are adjusted to satisfy the following relationship:

$$(-V2'+n\cdot Vt+Vb)/\rho d>0$$

where

ρd represents a charge density of the toner layer immediately after the image support passes through the development nip, Vt (V) represents a potential of the toner layer on the developing member, Rr ($\Omega\cdot m^2$) represents a resistance of the developing member, and n represents a ratio (vb/vp) of a rotational speed vb (m/sec) of the developing member to a rotational speed vp (m/sec) of the image support.

In accordance with the twelfth aspect of the present invention the developing method having the above eleventh aspect is further characterized in that values of the following parameters are adjusted to satisfy the following relationship:

$$(-(V2'+dV)+n\cdot Vt+Vb)/\rho d>0$$

where dV (V) represents a variation in the surface potential of the image support due to a friction with the toner when the surface of the image support passes through the development nip.

In accordance with the thirteenth aspect of the present invention, the developing method having the above first or seventh aspect is further characterized in that values of the following parameters are adjusted to satisfy the following relationship:

$$Rr/n\leqq(dt/\in t+dp/\in p)$$

where dp (m) represents a thickness of the photosensitive unit layer of the image support, ∈p (F/m) represents a permittivity thereof, dt (m) represents a thickness of the toner layer before the development, ∈t (F/m) represents a permittivity thereof, Rr ($\Omega\cdot m^2$) represents a resistance of the developing member, and n represents a ratio (vb/vp) of a rotational speed vb (m/sec) of the developing member to a rotational speed vp (m/sec) of the image support.

In accordance with a fourteenth aspect of the present invention, the developing method having the above thirteenth aspect is further characterized in that, when the image support has a resistance layer of Rp ($\Omega\cdot m^2$), values of the following parameters are adjusted to satisfy the following relationship:

$$Rr/n+Rp\leqq(dt/\in t+dp/\in p)$$

In accordance with the fifteenth aspect of the present invention, the developing method having the above first or seventh aspect is characterized in that, when a toner layer is formed on the surface of the developing member that is applied with a bias voltage Vb (V), and when this developing member is brought into a sliding contact with the surface of the image support by a development nip of a predetermined width, values of the following parameters are adjusted to satisfy the following relationship:

$$-(Vsat+dV)+Vb+n\cdot Vt\geqq\eta\cdot(n\cdot dt)\cdot\rho d\cdot(dt/\in t+dp/\in p+Rr/n+Rp)$$

where

Vsat (V) represents a saturated value of a potential of an image portion in the image support, dp (m) represents a thickness of the photosensitive unit layer of the image support, ∈p (F/m) represents a permittivity thereof, ρd (C/m) represents a charge density of the toner layer immediately after the surface of the image support passes through the development nip, dt (m) represents a thickness of the toner layer, ∈t (F/m) represents a permittivity thereof, Rr ($\Omega\cdot m^2$) represents a resistance of the developing member, dV (V) represents a variation in the surface potential of the image support due to a friction with the toner when the surface of the image support passes through the development nip, n represents a ratio (vb/vp) of a rotational speed vb (m/sec) of the developing member to a rotational speed vp (m/sec) of the image support, and η represents a permissible value of development efficiency.

In accordance with the sixteenth aspect of the present invention, the developing method having the above fifteenth aspect is further characterized in that Pp or dv is omitted or its value is set to zero (0) when it is possible to disregard a variation in the surface potential of the image support due to a friction with the toner at the time of passing through the development nip, or when the image support does not have a resistance layer or when this can be disregarded.

In accordance with the seventeenth aspect of the present invention, the developing method having the above first or seventh aspect, is further characterized in that, when $\gamma=(1/\eta)-1$, a resistance Rr of the developing member and a resistance Rp of the resistance layer of the image support are set to satisfy the following relationship:

$$Rr/n+Rp \leqq \gamma \cdot (dt/\in t+dp/\in p).$$

In accordance with the eighteenth aspect of the present invention, the developing method having the above seventeenth aspect is further characterized in that Pp is omitted or its value is set to zero (0) when the image support does not have a resistance layer or when this can be disregarded.

According to the first aspect, it is possible to set a development starting voltage at which it is possible to draw a marginal value of deterioration in the image quality due to a diffusion of a charge, that is, a marginal value of the resolution. Therefore, by adjusting the development condition based on this development starting voltage, it becomes possible to form an electrostatic latent image according to an original image that is expressed in high resolution. As a result, it becomes possible to realize a satisfactory image quality.

Further, according to the setting of the second aspect, it is possible to obtain a development starting voltage by taking into account a dark attenuation.

Further, when various values are adjusted to satisfy the conditions of the third and fifth aspects, it is possible to obtain a development starting voltage by taking into account a moving rate, a toner layer thickness, etc. When the development starting voltage is set more strictly as explained above, it becomes possible to prevent a reduction in the resolution and to realize a more satisfactory image quality, by reducing the influence of a charge diffusion on the electrostatic latent image of an original image prepared in high resolution.

Further, when various values are adjusted to satisfy the conditions of the fourth and sixth aspects, it is possible to obtain a development starting voltage by taking into account a frictional charging due to a friction between the surface of the image support and the toner in the development nip.

Further, according to the setting of the seventh aspect, it is possible to realize a satisfactory image quality of an original image prepared in high resolution.

Further, according to the development conditions as set in the thirteenth and fourteenth aspects, it is possible to obtain high development efficiency. As a result, it is possible to carry out a stable development.

Further, when various values are adjusted to satisfy the condition of the fifteenth aspect, it is possible to efficiently move the toner that is supplied to the development nip to the image support. Therefore, it becomes possible to guarantee the development efficiency above the expected level. As a result, the toner can be consumed effectively by preventing deterioration of the toner and the adhesion of the toner. This enables to have a long life of the toner and the image support respectively.

Further, according to the setting of the seventeenth aspect, it becomes possible to obtain resistance values to secure high development efficiency. Thus, it is possible to prevent a reduction in the development volume that occurs when each resistance is higher than the set value. As a result, it is possible to increase the development efficiency.

DETAILED DESCRIPTION OF THE PREFERRED EMBODIMENTS

Figure 1:
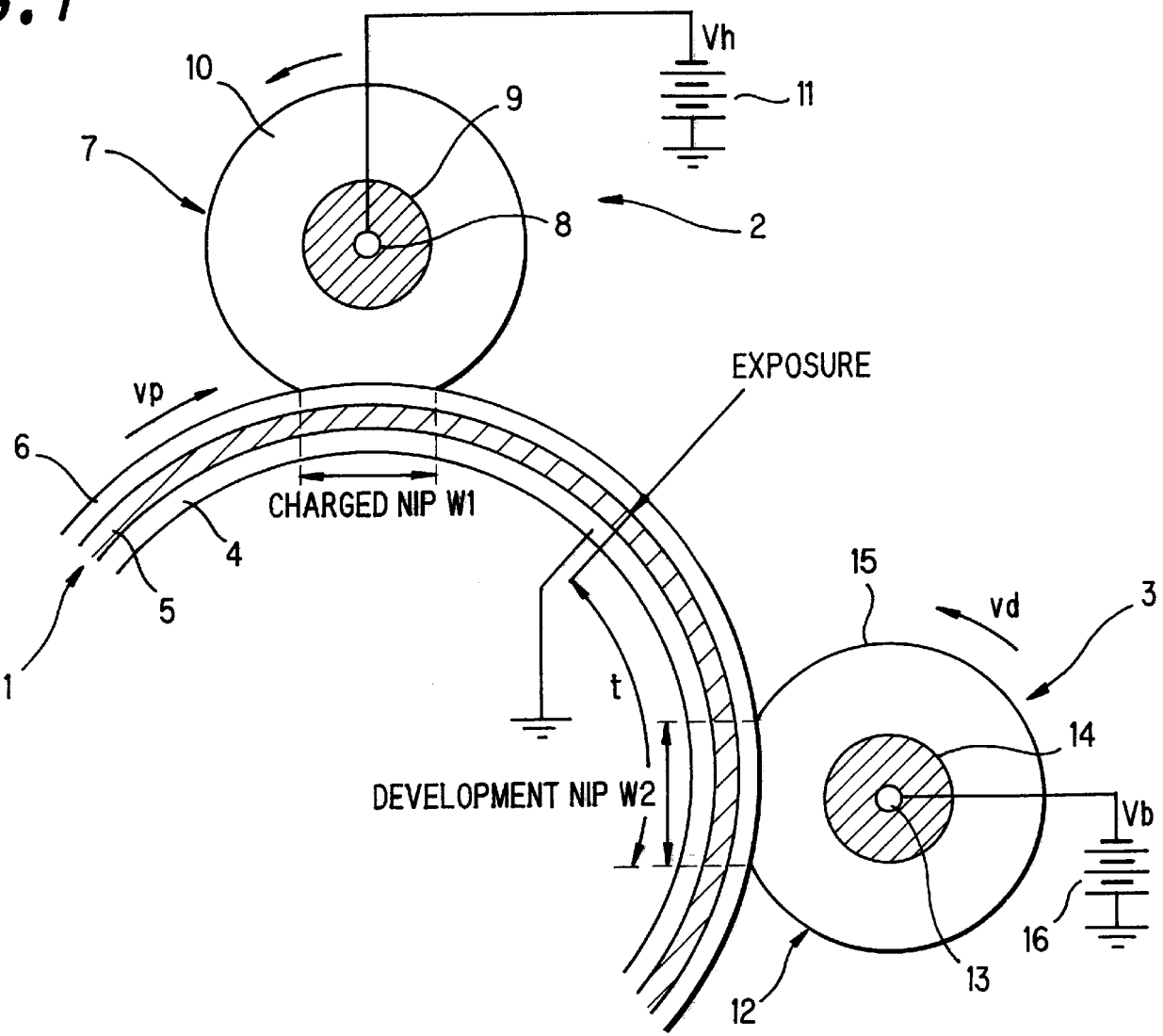
FIG. 1 is a schematic configuration diagram of main portions of an image formation apparatus according to the present invention.
Figure 2:
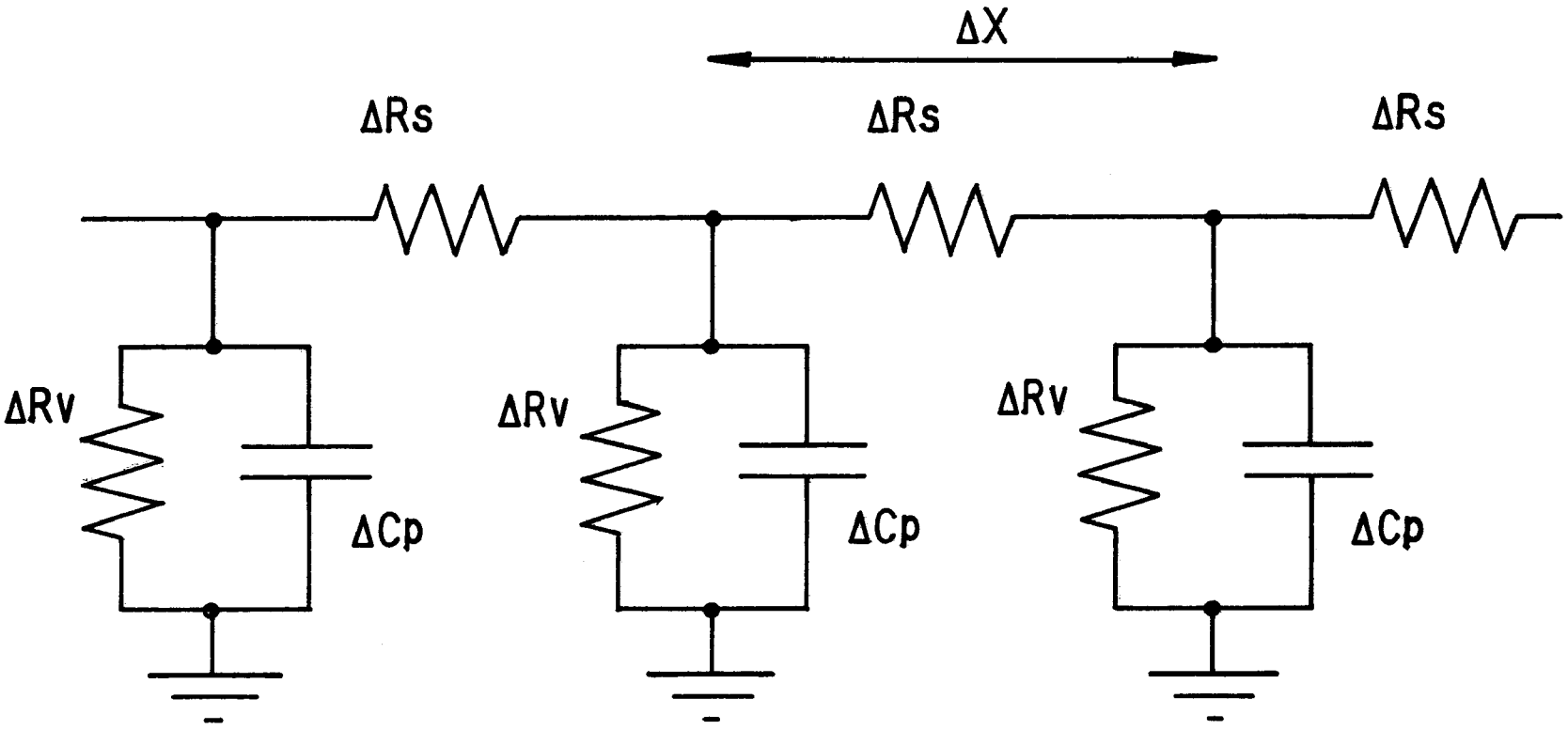
FIG. 2 is an electric equivalent circuit diagram of a photosensitive unit.

One embodiment of an image formation apparatus of an electronic photographing system to which a developing method of the present invention is applied will be explained with reference to the drawings. In this image formation apparatus, a development is carried out based on an inversion development system. Around a drum-shaped photosensitive unit as an image support, there are disposed a charging unit, an exposing unit, a developing unit, a transfer unit, a cleaning unit, and a discharging unit. FIG. 1 shows a schematic configuration of main portions of the image formation apparatus. A photosensitive unit 1 from which a remaining toner has been removed by a unillustrated cleaning unit is charged with a predetermined negative voltage Vh by a charging unit 2. An electric charge on the surface of the photosensitive unit 1 is removed by an exposure of an original image, and an electrostatic latent image is formed on this surface. The electrostatic latent image is developed into a developed toner image by a uni-component non-magnetic developer supplied from a developing unit 3. This image is transferred onto a sheet of recording paper by a unillustrated transfer unit.

The photosensitive unit 1 is formed by having a high-resistance layer 5 for preventing a leak current and a photosensitive layer 6 which are laminated onto a cylindrical conductive base material 4 made of aluminum. The base material 4 is rotatably supported via a rotary axis, and is grounded.

The charging unit 2 is formed by having a resistance layer 10 made of a low-resistance elastic material laminated onto a cylindrical conductive base material 9 provided around a rotatable metal shaft 8 by using a charged roller 7. A constant-voltage power source 11 is connected to the metal shaft 8, and a predetermined negative voltage Vh is being applied to the metal shaft 8. The charged roller 7 is closely contacted to the surface of the photosensitive unit 1 at a charge nip W1.

The developing unit 3 is formed by having a resistance layer 15 made of a low-resistance elastic material laminated onto a cylindrical conductive base material 14 provided around a rotatable metal shaft 13 by using a developing roller 12 as a developing member. A constant-voltage power source 16 is connected to the metal shaft 13, and a predetermined negative voltage Vb as a development bias is being applied to the metal shaft 13. The developing roller 12 is closely contacted to the surface of the photosensitive unit 1 at a development nip W2. The developing roller 12 is supplied with a toner from a unillustrated toner hopper, and the thickness of the toner layer is regulated by a doctoring unit.

The photosensitive unit 1 is driven to rotate at a rotational speed vp, and the charged roller 7 that is in sliding contact with the surface of the photosensitive unit 1 rotates following the rotation of the photosensitive unit 1. The developing roller 12 is driven to rotate in the opposite direction at a rotational speed vd faster than the photosensitive unit 1. Eventhough unillustrated, as to the exposing unit, the transfer unit, the cleaning unit, and the discharging unit, conventional units are used respectively.

In the image formation apparatus having the above-described structure, first, it has been assumed that it is possible to apply a relationship similar to that of the Thomson cable of a distribution constant circuit or a thermal conduction equation, between a latent image potential V1 (V) that has an optional exposure width W and a potential Vo (V) of a non-image portion of an electrostatic latent image in an image area at the time of an exposure. Based on this assumption, the conventional data shown in FIG. 3 has been arranged to obtain the following expression (7).

$$V1=(0.348\ Wr^2-1.161\ Wr+1.0163)V0 \tag{7}$$

where $$Wr=(1/3.63)\cdot(Rs\cdot Cp/t)^{1/2}\cdot W \tag{8}$$

W represents a width (m) of an edge when the potential of a latent image at a boundary between an exposed portion and an unexposed portion is 90% to 10% when an exposure has been carried out with a uniform distribution of optical power and with a sufficient width. This corresponds to a desired minimum image width. Cp represents an electrostatic capacity (F/m$^2$) per unit area of the photosensitive unit 1. Rs represents a surface resistance (Ω) per unit length, and t represents a moving time (sec) from an exposed area to a development completion area.

When the surface voltage of the photosensitive unit 1 is Vth (V) at the time when the development unit starts a development, it becomes possible to form a toner image onto the photosensitive unit 1 by satisfying the following condition:

$$abs(V1)<abs(Vth) \tag{9}$$

where abs (X) is an absolute value of X.

The process of drawing the above expressions (7), (8) and (9) will be explained in detail. The present inventor has carried out an investigation using a potential distribution on the photosensitive unit 1 by exposure as an initial condition, based on the following basic expressions of changes in the potential on the photosensitive unit 1, in a similar manner to that of the prior art.

$$(\delta V/\delta t)=(1/(Rs\cdot Cp))\cdot(\delta V^2/\delta x^2)-V/(Rv\cdot d\cdot Cp) \tag{10}$$

$$V=Vs(x,\ t)\cdot\exp(-t/(Rv\cdot d\cdot Cp)) \tag{11}$$

which is a general solution of the expression (10), and $$V(x,\ t)=Vo\cdot erfc(0.5\cdot(Rs\cdot Cp/t)^{1/2}\cdot X) \tag{12}$$

which is a solution when a step voltage is applied to one end in the expression (11).

Figure 3:
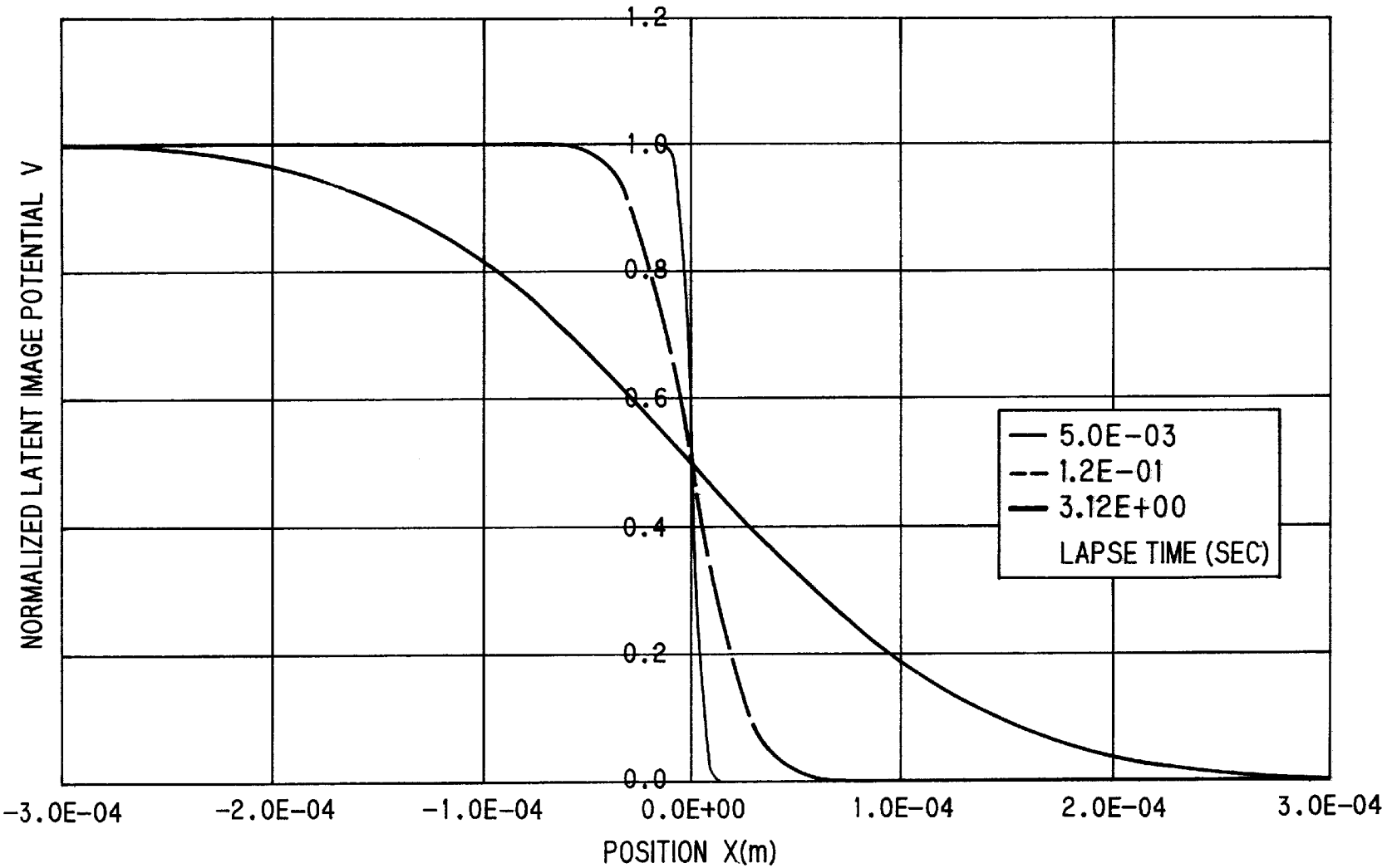
FIG. 3 is a diagram showing a diffusion of an electrostatic latent image along with a lapse of time on the surface of the photosensitive unit.

Then, it has been confirmed that the following expression (13) is established by giving attention to a width $W_{90\text{-}10}$ of an edge when the potential of the latent image in the data of FIG. 3 shown in Table 1 is 90% to 10%.

$$0.5\cdot(Rs\cdot Cp/t)^{1/2}\cdot W_{90\text{-}10}=1.813\ (\text{const}) \tag{13}$$

TABLE 1

| Cp (F/m$^2$) | Rs (Ω) | Cp · Rs | t (sec) | $W_{90\text{-}10}$ (m) | α |
|---|---|---|---|---|---|
| 1.33E−06 | 3.33E+15 | 5.00E+08 | 3.13E+00 | 2.87E−04 | 1.81E+00 |
| 1.33E−06 | 3.33E+15 | 5.00E+08 | 1.25E−01 | 5.73E−05 | 1.81E+00 |
| 1.33E−06 | 3.33E+15 | 5.00E+08 | 5.00E−03 | 1.15E−05 | 1.81E+00 |

α^ = 0.5*(c*r/t) 0.5*$W_{90\text{-}10}$

Figure 4:
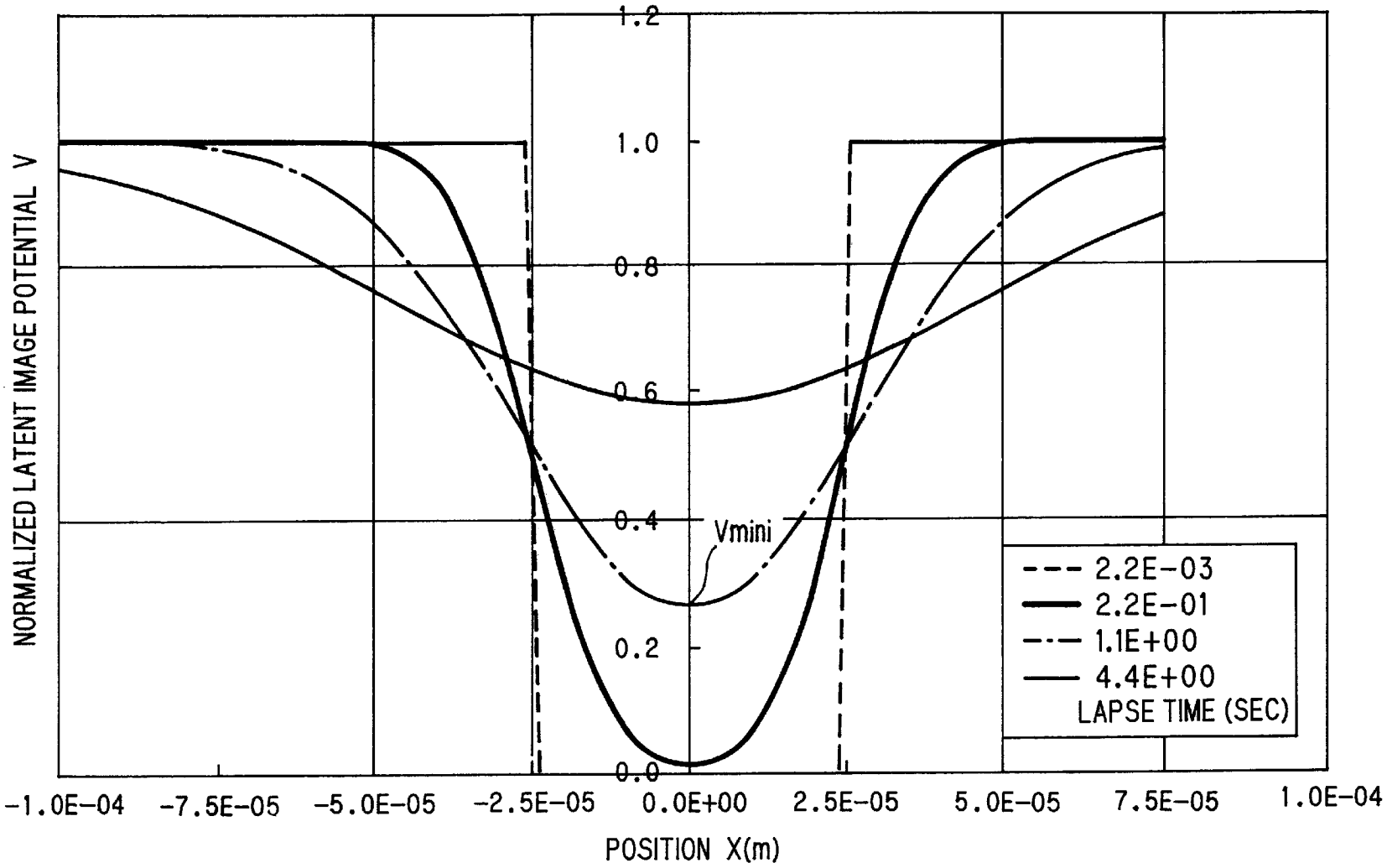
FIG. 4 is a diagram showing a change in the electrostatic latent image along with a lapse of time.
Figure 5:
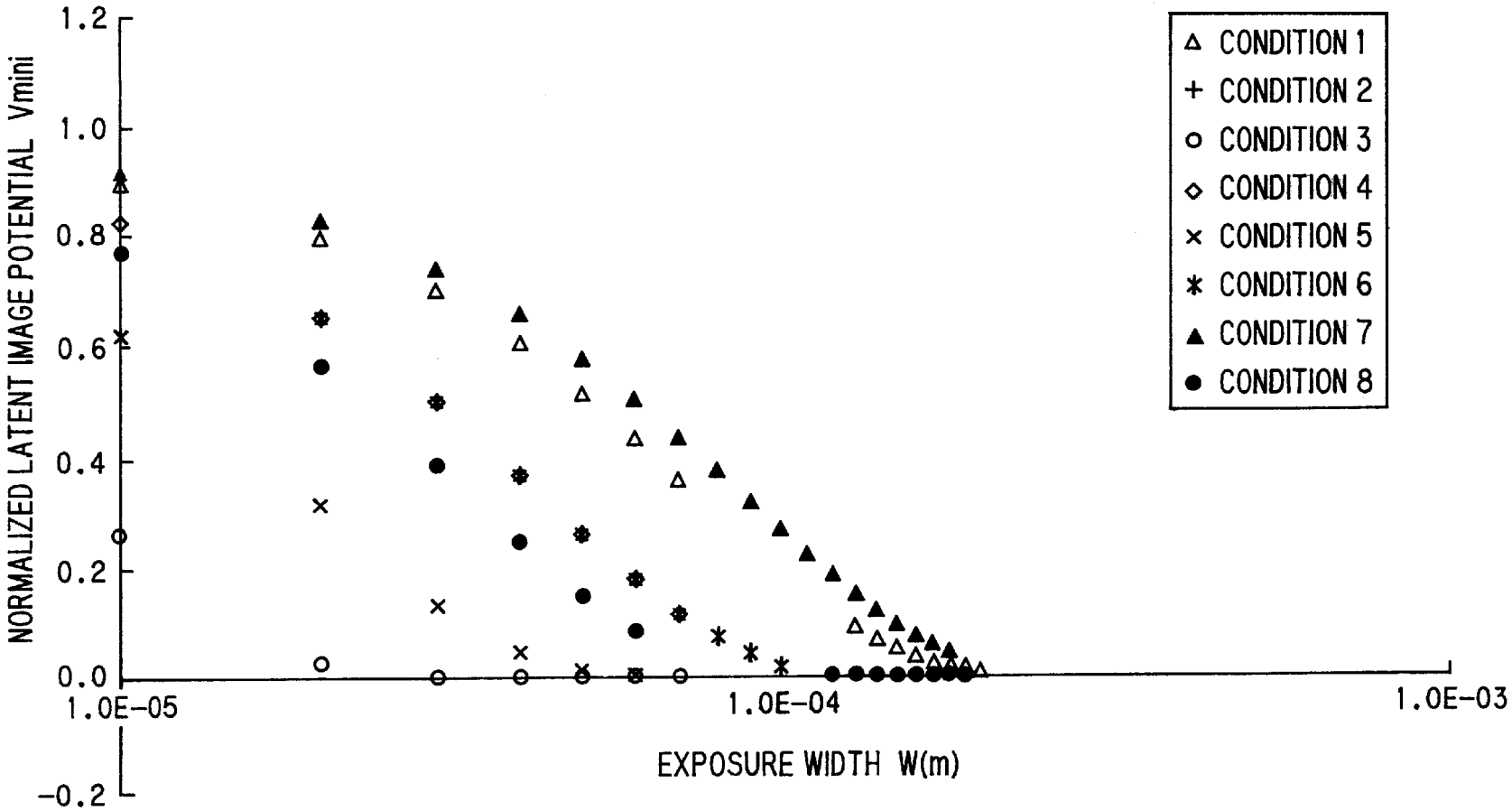
FIG. 5 is a diagram showing a relationship between a normalized latent image potential and an exposure width.

Next, an exposure is carried out such that the distribution of optical power is a square as shown in FIG. 4, to follow an actual using state. Thus, a latent image potential when an isolated line is formed is obtained. The profile of the latent image potential changes variously based on the combination of the exposure width, the electrostatic capacity Cp of the photosensitive unit 1, the surface resistance Rs, and the moving time t from the exposed area to the development completion area. FIG. 5 shows a result of plotting a normalized latent image potential Vmini for the exposure width W under conditions 1 to 8 shown in Table 2, where the normalized latent image potential Vmini is a normalized minimum potential based on a fact that the center of the exposure becomes a minimum value of the latent image potential.

TABLE 2

| | ρv (Ω · m) | dp (m) | Cp (F/m$^2$) | Rs (Ω) | Cp · Rs | t (sec) | $W_{90\text{-}10}$ (m) |
|---|---|---|---|---|---|---|---|
| Condition 1 | 1.0E+06 | 1.5E−05 | 1.8E−06 | 3.3E+11 | 5.9E+05 | 4.4E−04 | 9.9E−05 |
| Condition 2 | 1.0E+09 | 1.5E−05 | 1.8E−06 | 3.3E+14 | 5.9E+08 | 1.5E−01 | 5.7E−05 |
| Condition 3 | 1.0E+12 | 1.5E−05 | 1.8E−06 | 3.3E+17 | 5.9E+11 | 5.9E+00 | 1.2E−05 |
| Condition 4 | 1.0E+09 | 1.0E−05 | 2.7E−06 | 3.3E+14 | 8.9E+08 | 2.2E−01 | 5.7E−05 |
| Condition 5 | 1.0E+10 | 2.0E−05 | 1.3E−06 | 3.3E+15 | 4.4E+09 | 2.2E−01 | 2.6E−05 |
| Condition 6 | 1.0E+10 | 2.0E−05 | 1.3E−06 | 3.3E+15 | 4.4E+09 | 1.1E+00 | 5.7E−05 |
| Condition 7 | 1.0E+10 | 2.0E−05 | 1.3E−06 | 3.3E+15 | 4.4E+09 | 4.4E+00 | 1.1E−04 |
| Condition 8 | 1.0E+10 | 6.7E−06 | 4.0E−06 | 3.3E+15 | 1.3E+10 | 2.0E+00 | 4.4E−05 |

Figure 6:
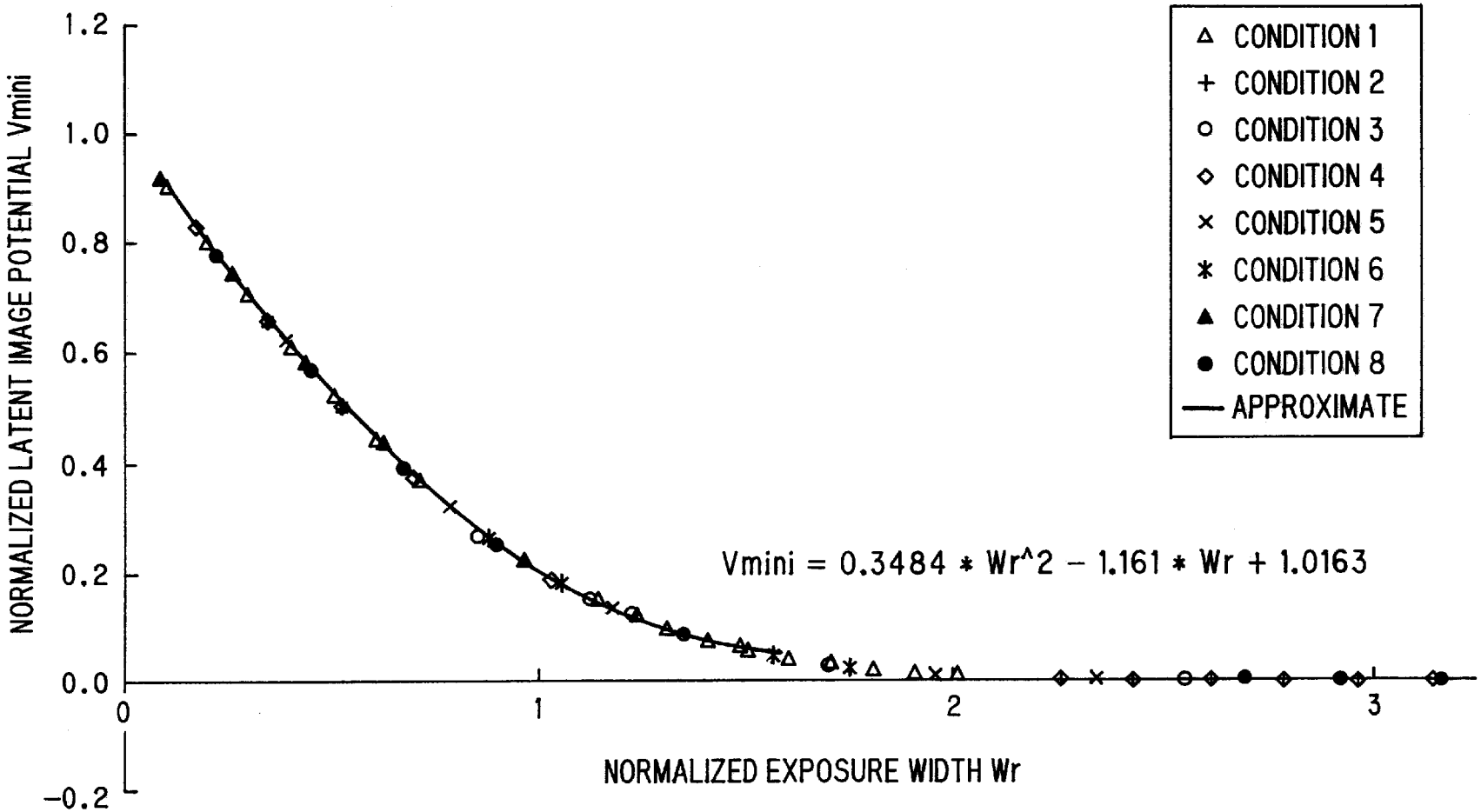
FIG. 6 is a diagram showing a relationship between a normalized latent image potential and a normalized exposure width.

Although a correlation between the two cannot be read out from FIG. 5, the present inventor paid attention to the edge width $W_{90\text{-}10}$, and obtained a normalized exposure width Wr by dividing the exposure width W by the width $W_{90\text{-}10}$, as shown by the expression (14). FIG. 6 shows a result of the plotting of the normalized exposure width Wr.

$$Wr=W/W_{90\text{-}10}=(0.5\cdot(Rs\cdot Cp/t)^{1/2})/1.813\cdot W=(1/3.63)\cdot(Rs\cdot Cp/t)^{1/2})\cdot W \tag{14}$$

From FIG. 6, it can be understood that there is a constant relationship between the normalized width Wr and the normalized latent image potential Vmini. Thus, the following approximate expression (15) is obtained for the latent image potential Vmini.

$$Vmini=(0.348Wr^2-1.161Wr+1.0163)\cdot V0 \quad (15)$$

Based on the result of the investigation by the present inventor shown in FIG. 6 and Table 2, it can be understood that the relationship between the normalized exposure width Wr and the normalized latent image potential Vmini is on the curve of the expression (7) even when the exposure width W, the electrostatic capacity Cp of the photosensitive unit 1, the surface resistance Rs, and the moving time t from the exposed area to the development completion area are changed.

As explained above, it becomes possible to obtain a correlation between an optional photosensitive unit potential Vo, the edge width W and the latent image potential Vmini. By suitably setting the development starting voltage Vth to the latent image potential Vmini, it becomes possible to form a predetermined toner image. The latent image potential Vmini becomes the marginal latent image potential V1 at which an image of the minimum image width can be formed.

Therefore, it is possible to obtain a resolution at an optional latent image potential following an actual using state, such as, for example, the development potential at which a highest resolution can be obtained by leaving the characteristics of the photosensitive unit 1 as they are, and the development potential that can guarantee the initial performance despite an adhesion of a stain. As a result, it is possible to obtain the marginal latent image potential V1 at which a picture quality deterioration occurs such as a reduction in the resolution due to the increase in the width of a latent image to a larger level than the actual exposure width due to the diffusion of the charge. Based on this marginal latent image potential V1 obtained, it is possible to suitably set the development starting voltage Vth according to the expression (9). This enables to prevent the above-described deterioration in the image quality.

In the above expression (9), the following relationship can be set when a resistance per unit area of the photosensitive unit 1 in the thickness direction is Rv ($\Omega m^2$).

$$abs(V1')<abs(Vth) \quad (16)$$

where $$V1'=V1\cdot\exp(-t/(Rv\cdot Cp)) \quad (17)$$

Thus, it becomes possible to set a marginal value of the latent image potential that takes into account a dark attenuation that a charged potential is diffused to the thickness direction of the photosensitive unit 1 in the darkness. Therefore, it is possible to realize a satisfactory image quality that is in more conformity with the actual using state when the image is in high resolution.

Considering the photosensitive unit 1 of which permittivity is $\in p$ (F/m) and volume intrinsic resistance is $\rho v(\Omega\cdot m)$ with no adhered material on the surface of the photosensitive unit 1, and a fine cube having a thickness dp (m), a width $\Delta W$ (m), and a length $\Delta x$ (m), the following relationships are obtained.

$$\Delta Cp = Cp\cdot\Delta x\cdot\Delta W \qquad Cp = \varepsilon p/dp$$

$$\Delta Rs = Rs\cdot\Delta x\cdot\Delta W \qquad Rs = \rho v/dp$$

$$\Delta Rv = Rv/(\Delta x\cdot\Delta W) \qquad Rv = \rho v/dp$$

In other words, the electrostatic capacity, the surface resistance and the resistance in the thickness direction of the photosensitive unit 1 respectively are influenced by the thickness of the photosensitive unit 1. Therefore, it is necessary to take into account the dark attenuation.

The above explains the case of using the conductive developing roller 12. Next, the process of obtaining the development characteristics when the semiconductive developing roller 12 is used will be explained. The semiconductive developing roller 12 is formed by having a layer of semiconductive elastic material laminated on the cylindrical conductive base material 14.

Figure 7:
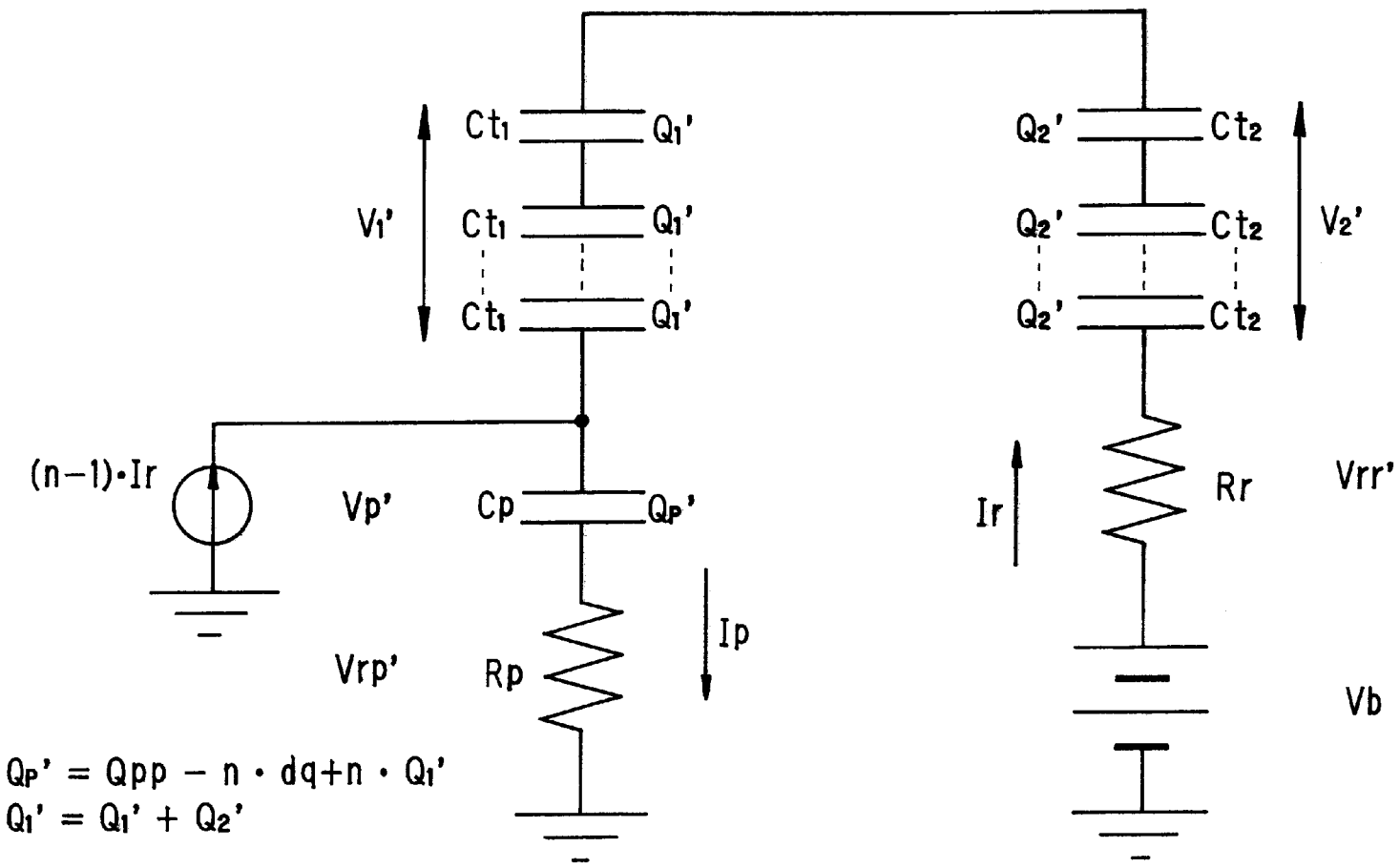
FIG. 7 is an electric equivalent circuit diagram when a semiconductive developing roller is used.

FIG. 7 shows an equivalent model of a developing operation that takes into account a rotational speed rate. The route of a development current can be expressed by a series circuit consisting of a resistance Rp of the resistance layer 5 of the photosensitive unit 1, an electrostatic capacity Cp of the photosensitive unit 1, two electrostatic capacities Ct1 and Ct2 expressed by two capacitors when the toner layer formed on the surface of the developing roller 12 is divided into an area that shifts to the photosensitive unit 1 and an area that remains on the developing roller 12, a resistance Rr of the resistance layer 15 of the developing roller 12, and the high-voltage DC power source 16 for generating a development bias Vb.

The model has the high-resistance resistance layer 5 also disposed on the photosensitive unit 1 side. This takes into account that there have been proposals of a contact charging technique of the photosensitive unit 1 where a resistor is disposed at the photosensitive unit 1 side. One example of the structure is that a resistance layer provided on the charged roller 7 and the developing roller 12 respectively is provided at the photosensitive unit 1 side. As the resistance component of the charged roller 7 itself is a low resistance, the manufacturing becomes easy. Even if there is a variation in the resistance value due to a variance between the lots and environmental factors such as humidity, the variation size can be minimized. Thus, they do not affect the charge characteristics or development characteristics. As the resistance layer 5 is formed by being coated onto the photosensitive unit 1, this layer has small risk of moisture absorption. As a result, it is possible to restrict the variation in the resistance value.

Further, when the base material 4 of the photosensitive unit 1 is formed by a conductive resin having a low hygroscopicity, such as a polycarbonate resin dispersed with carbon black, thereby to work also as a resistance layer, thus it is not necessary to separately provide a resistance layer. As a result, the photosensitive unit 1 can be formed in a simple structure. Further, it is also possible to simplify the structure of the photosensitive unit 1 by forming the resistance layer 5 to work also as a charge injection preventive layer provided in the photosensitive unit 1.

As a second example of having the resistance layer 5 at the photosensitive unit 1 side, there has been proposed in Japanese Patent Application Laid-open Hei 8 No. 69156 a method of directly injecting a charge into the photosensitive unit 1 via the resistance layer 5, by having the resistance layer 5 disposed on the top surface of the photosensitive unit as a technique for restricting a low resistance and generation of ozone in the contact charging.

When the structure of having the resistance layer 5 at the photosensitive unit 1 side is also taken into account, it is possible to carry out a development capable of obtaining a high resolution by setting parameters as described blow.

In studying the development characteristics, first, an equilibrium of the electric field is obtained by taking into account a drop in the voltage due to the development current and a move of the charge. An approximate expression for obtaining a development volume Mp is shown below. It is assumed that a charge density of a toner layer is expressed as ρ ($C/m^3$), a film thickness of the toner layer before a development is expressed as dt (m), a permittivity of the toner layer is expressed as ∈t (F/m), a resistance of the resistance layer 15 of the development roller 12 in the thickness direction per unit area is expressed as Rr ($\Omega \cdot m^2$), a thickness of the photosensitive unit layer 6 is expressed as dp (m), a permittivity of the photosensitive unit 1 is expressed as ∈p (F/m), a resistance of the resistance layer 5 of the photosensitive unit 1 in the thickness direction per unit area is expressed as Rp ($\Omega \cdot m^2$), a surface potential of the photosensitive unit immediately before proceeding into the development nip is expressed as Vo (V), a development bias is expressed as Vb (V), and a rotational speed rate of the speed vd of the developing roller 12 to the speed vp of the photosensitive unit is expressed as n=vd/vp.

An equivalent model (capacitor model) that takes into account the speed rate becomes as shown in FIG. 7. It is assumed that voltages of the photosensitive unit-side resistance layer 5, the photosensitive unit layer 6, the photosensitive unit-side toner layer, the developing roller-side toner layer, and the developing roller resistance layer 15 are expressed as Vrp', Vp', V1', V2', and Vrr' respectively. Then, the following expression (18) is obtained based on a disconnection condition of the toner layer under which the electric field of the toner layer becomes zero.

$$Vrp'+Vp'+V1'=V2'-Vrr'+Vb \tag{18}$$

It is assumed that a charge of the toner layer on the photosensitive unit 1 after the development is expressed as n·Q1', a thickness of this toner layer is expressed as X, a charge of the photosensitive unit 1 before proceeding into the development nip is expressed as Qpo, and a charge of the toner layer before proceeding into the development nip is expressed as Qt.

It is also assumed that a charge generated at the toner layer side by the friction between the photosensitive unit 1 and the toner at the time of passing through the development nip is expressed as dq, and a charge generated at the photosensitive unit side is expressed as −n·dq having an inverse polarity. Variations in the charge density and the charged volume are expressed as dρ and dq respectively. In other words, the charge of the toner layer after passing through the development nip is expressed as Qt'=Qt+dq, and the charge density of the toner layer is expressed as ρd=ρ+dρ.

When the development volume n·Q1' and the rotational speeds vp and vd are taken into account, the development current per unit area on the developing roller 12 becomes Ir=Q1', and the development current per unit area on the photosensitive unit 1 becomes Ip=n·Q1'. When these are substituted into the expression (18), the following expression (19) is obtained.

$$n\cdot Q1'/Rp+(Qpo-n\cdot dq+n\cdot Q1')/Cp+n\cdot Q1'/C1=n\cdot Q2'-Q1'\cdot Rr+Vb \tag{19}$$

When the following relations are used, $$(\rho+d\rho)\cdot X=n\cdot Q1'$$

$$Qt'=Q1'+Q2'$$

$$1/C1+1/C2=dt/(2\cdot\in t)$$

$$Ct=\in t/dt$$

$$Vt'=(\rho+d\rho)\cdot dt\ \hat{}\ 2/(2\cdot\in t)$$

$$dV=-n\cdot dq/Cp$$

the expression (19) can be rearranged as follows.

$$X=(-(Vo+dV)+n\cdot Vt'+Vb)/(\rho+d\rho)\cdot(Rp+1/Cp+1/Ct+Rr/n)) \tag{20}$$

where $$0\leqq X\leqq n\cdot dt$$

Regarding the charge dq based on the frictional charging at the time of passing through the development nip, the process of gradually expanding a gap after the separation has been studied by modeling this process using a capacitor. As a result of the study, it has been made clear that not all the charge dq that has been given at the nip portion shifts at the time of the separation. Instead, a first shift of the charge occurs when the charge has been given. This shift volume is determined by the electrostatic capacities Cp and Ct of the photosensitive unit and the toner layer respectively. When the separation starts, a second shifting of the charge occurs mildly in the opposite shift direction to that of the first shifting. Finally, the given initial value is restored. For example, when the OPC film thickness of the photosensitive unit 1 is 20 μm and the toner layer thickness is 12 μm, approximately 30% of the charge dq shifts in the first shifting of the charge immediately after the charge has been given. The idea that the above expression takes into account a development current component for the charge dq of the toner that remains on the developing roller 12 is not adopted, because of the fact that the variation in the charge of the toner layer between before and after the development is about 30% or below, and not higher than about 10% in total, that it is reasonable to consider that a frictional charging occurs in the whole nip area, and that the variation finally converges to zero by the separation.

When the toner adhesion volume on the developing roller 12 before the development is expressed as m ($kg/m^2$), a development volume Mp ($kg/m^2$) is given by the following expression (21).

$$Mp=(m/dt)\cdot X \tag{21}$$

When the resistance layer 5 of the photosensitive unit 1 is not disposed, zero (0) may be substituted into Rp, or Rp may be erased in the expression (20). When it is possible to disregard the friction in the developing nip, zero (0) may be substituted into dV and dρ, or dV and dρ may be erased.

Figure 8:
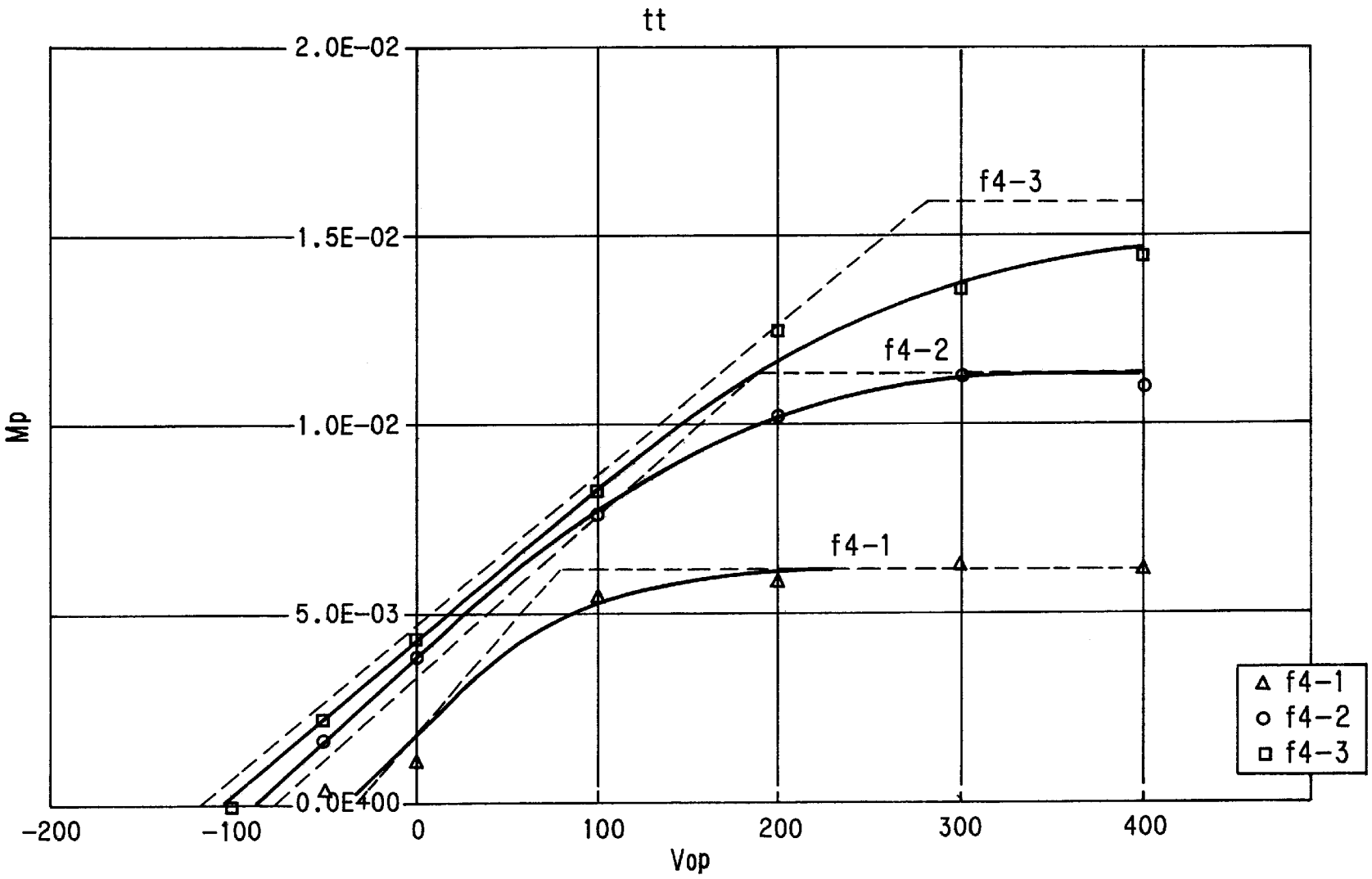
FIG. 8 is a diagram showing development characteristics of the conductive developing roller.
Figure 9:
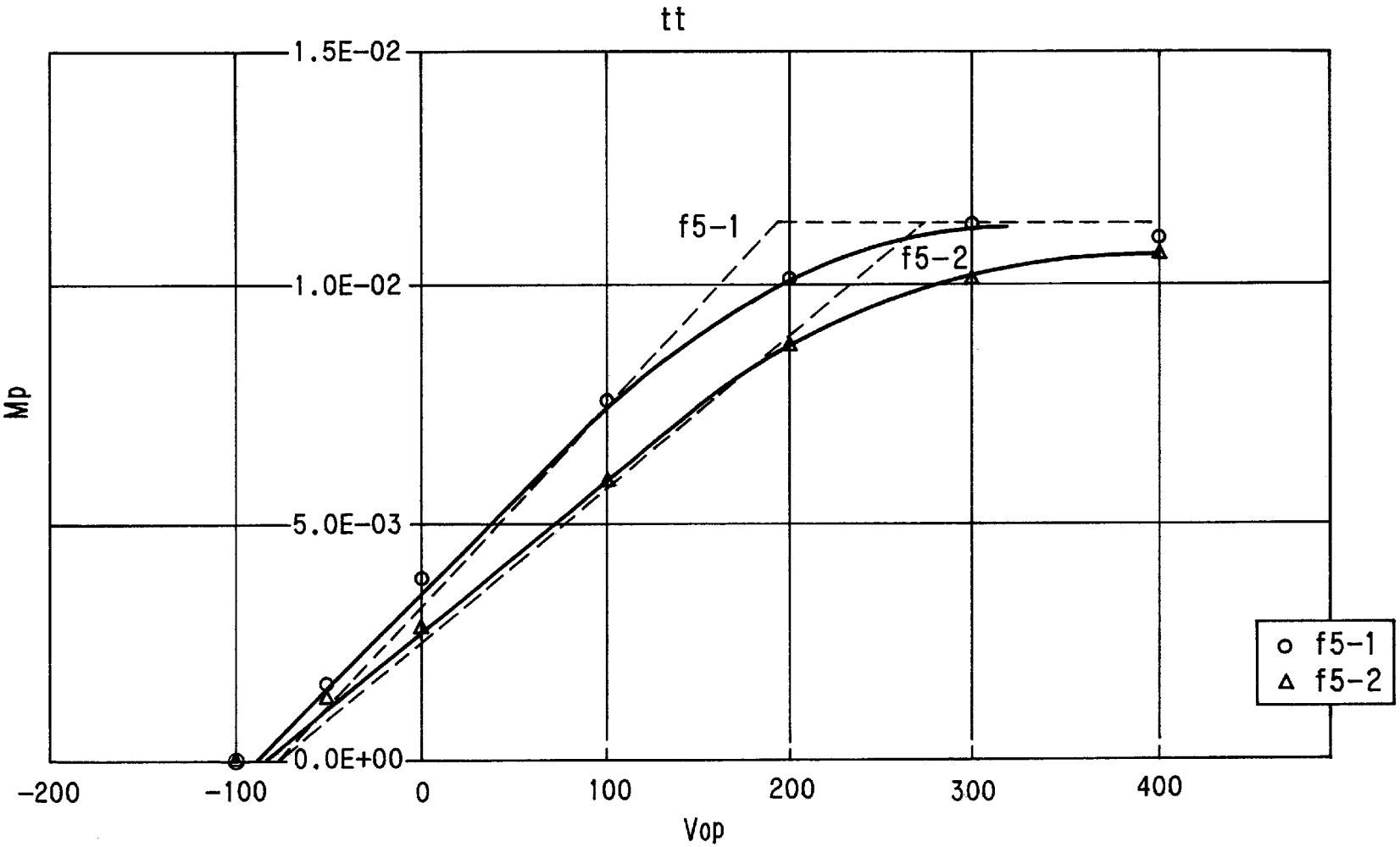
FIG. 9 is a diagram showing development characteristics of the semiconductive developing roller.

FIGS. 8 and 9 show examples of a result of obtaining the development characteristics using the expression (21). An abscissa Vop is Vo−Vb (V), and an ordinate is Mp ($kg/m^2$). FIG. 8 shows a case where the developing roller 12 is a conductive roller. Each plot shows an actually measured value. A curve f4−1 shows a case when n=1.3, f4−2 shows a case when n=2.36, and f4−3 shows a case when n=3.32. FIG. 9 shows a case where the developing roller 12 is a semiconductive roller. Each plot shows an actually measured value, and n is fixed to 2.36. A curve f5−1 shows a case when the resistance of the developing roller 12 is 1.1E5 ($\Omega \cdot m^2$), and f5−2 shows a case when the resistance of the developing roller 12 is 1.3E6 ($\Omega \cdot m^2$).

Figure 10:
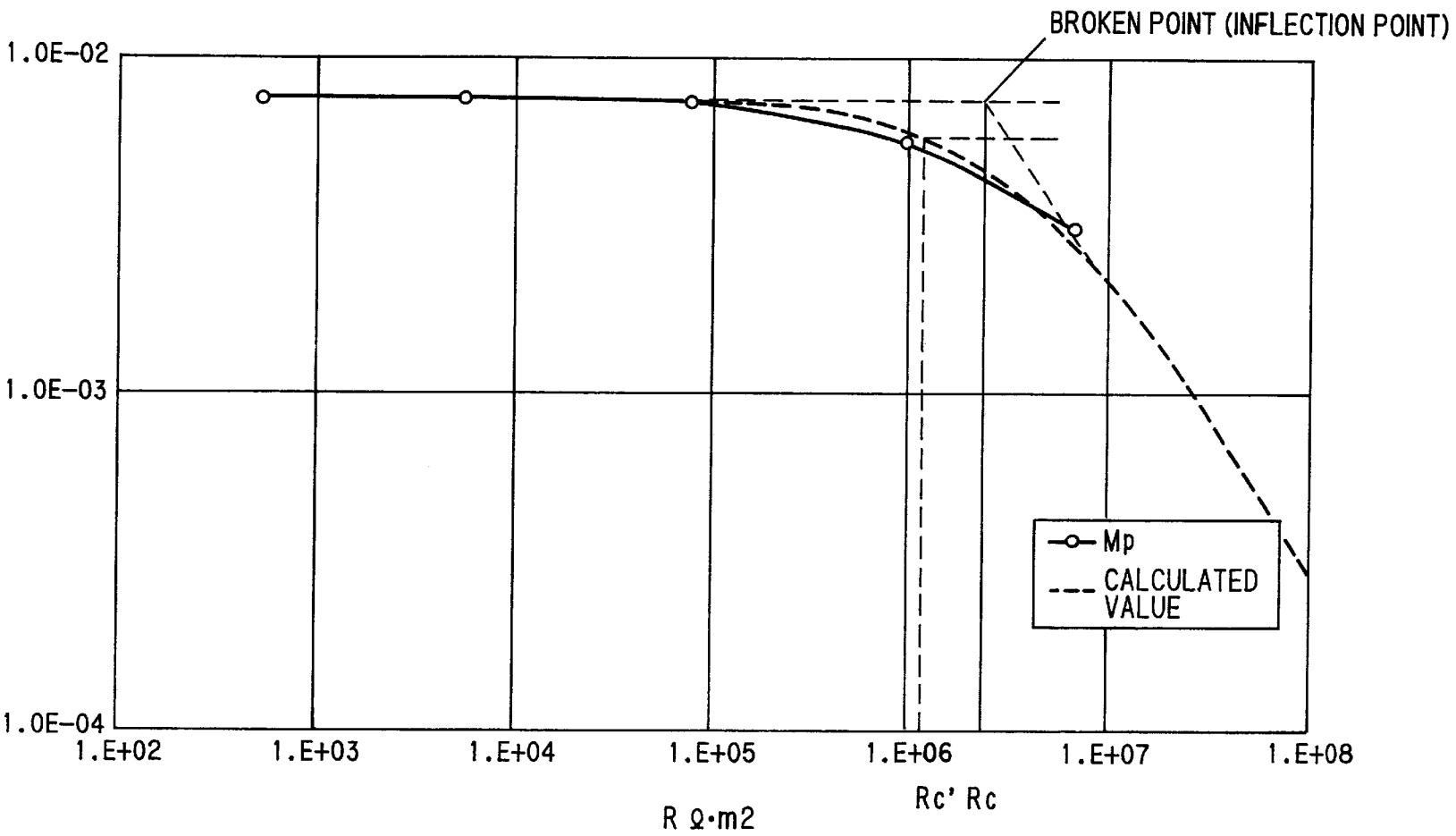
FIG. 10 is a diagram showing a relationship between a resistance of a developing roller and a development volume.

FIG. 10 shows a relationship between the resistance Rr of the developing roller 12 and the development volume Mp. In this case, Vo−Vb is set to 100 (V), and n is fixed to 2.3. Each plot shows an actually measured value. In FIG. 10, it is possible to obtain a high development efficiency at a resistance lower than a resistance Rc at a position of a broken point corresponding to a inflection point of the development volume Mp, or at a resistance below a resistance Rc' that is 80% of a maximum development volume Mp. Therefore, it is possible to carry out a stable development when the development characteristics in this area are used.

Therefore, when the marginal latent image potential V1 that takes into account the minimum image width is used in place of the photosensitive unit surface potential Vo in order to obtain a desired development volume Mp obtained from the expressions (20) and (21), it is possible to set a marginal value that takes into account the rotational speed rate and the toner layer width. In other words, when the charge dq based on the frictional charging can be disregarded, the following relationship is set.

$$(-V\mathbf{1}+n\cdot Vt+Vb)/\rho d>0 \tag{22}$$

or $$(-V\mathbf{1}'+n\cdot Vt+Vb)/\rho d>0 \tag{23}$$

When the photosensitive unit surface potential variation dV (=−dq·n/Cp) (V) due to the friction between the photosensitive unit 1and the toner in the development nip is taken into account, the following relationship is set.

$$(-(V\mathbf{1}+dV)+n\cdot Vt+Vb)/\rho d>0 \tag{24}$$

or $$(-(V\mathbf{1}'+dV)+n\cdot Vt+Vb)/\rho d>0 \tag{25}$$

When the resistance of the developing roller 12 is expressed as Rr ($\Omega\cdot m^2$) and the resistance of the resistance layer 5 of the photosensitive unit 1 is expressed as Rp ($\Omega\cdot m^2$), a resistance that satisfies the following relationship corresponds to the condition under which the resistance in FIG. 10 becomes a value not higher than Rc.

$$(Rp+Rr/n)/(dt/\in t+dp/\in p)\leqq 1 \tag{26}$$

In the above expression, dp represents a thickness (m) of the photosensitive unit layer 6, ∈p expresses a permittivity (F/m) of the photosensitive unit layer 6, dt expresses a toner layer width (m) before the development, and ∈t expresses a permittivity (F/m) of the toner layer.

Therefore, the development efficiency can be secured, and it becomes possible to carry out a stable development when the following relationships are set up:

When the resistance layer Rp is omitted, $$Rr/n\leqq(dt/\in t+dp/\in p) \tag{27}$$

and when the resistance layer Rp is taken into account, $$Rr/n+Rp\leqq(dt/\in t+dp/\in p) \tag{28}$$

The development efficiency η is expressed as follows:

$$\eta=(\text{the volume of the toner shifted onto the photosensitive unit})/(\text{the volume of the toner supplied to the development nip}) \tag{29}$$

When the toner layer width is used, the development efficiency η is expressed as follows.

$$\eta=(\text{the thickness of the toner layer on the photosensitive unit after the development})/(n\cdot dt) \tag{30}$$

A saturation value of the photosensitive unit surface potential of the image portion is expressed as Vsat, and a charge density of the toner layer immediately after passing through the development nip is expressed as ρd ($c/m^3$). These values are substituted into the expression (20), thereby to obtain the thickness of the toner layer on the photosensitive unit 1. This is then substituted into the expression (29). Then, the following expression is obtained.

$$-(V\text{sat}+dV)+Vb+n\cdot Vt\leqq\eta\cdot(n\cdot dt)\cdot\rho d\cdot(dt/\in t+dp/\in p+Rr/n+Rp) \tag{31}$$

Therefore, it becomes possible to prevent the toner deterioration and the toner adhesion by guaranteeing the permissible development efficiency value η or level above the development efficiency η. As a result, it becomes possible to secure a long life of the photosensitive unit 1.

Further, in order to make clear the influence of the resistance of the developing roller 12 and the resistance of the resistance layer 5 of the photosensitive unit 1, a toner layer thickness Xo when Rr and Rp≈0, and a toner layer thickness Xr when the resistances Rr and Rp are at predetermined values, are substituted into the expression (20). Then, Xo and Xr are obtained based on a potential condition under which Xo is not saturated. A rate of these two values is obtained as follows.

$$Xr/Xo=1/((Rp+Rr/n)/(dt/\in t+dp/\in p)+1) \tag{32}$$

Based on the above potential condition, the following relationship is obtained.

$$Xr/Xo\geqq\eta \tag{33}$$

The following is defined.

$$\gamma=(1/\eta)-1 \tag{34}$$

The expressions (32), (33) and (34) are summarized as follows.

$$Rr/n+Rp\leqq\eta\cdot(dt/\in t+dp/\in p) \tag{35}$$

Thus, a condition of the resistance for securing the development efficiency is obtained. As a result, it becomes possible to prevent the reduction in the development volume due to the resistance of the developing roller 12 and the resistance of the resistance layer 5 of the photosensitive unit 1.

In the case of the image formation apparatus that develops an electrostatic latent image based on a positive development, the exposure center becomes a maximum value of the electrostatic latent image contrary to the case of the inversion development. Therefore, a maximum latent image potential Vmax becomes as follows from the expression (7).

$$V\text{max}=Vo-V\mathbf{1}=(1-(0.348Wr^2-1.161Wr+1.0163))Vo \tag{36}$$

When the above expression is summarized, the latent image potential Vmax is expressed by a marginal latent image potential V2 as follows.

$$V\mathbf{2}=(-0.348Wr^2+1.161Wr-0.0163))Vo \tag{37}$$

The expression (9) becomes as follows.

$$abs(V\mathbf{2})>abs(Vth) \tag{38}$$

Similarly, the expressions (16), (17), and (22) to (25) can be set as follows respectively.

$$abs(V2')>abs(Vth) \quad (39)$$

$$V2'=V2/\exp(-t/(Rv\cdot Cp)) \quad (40)$$

$$(-V2+n\cdot Vt+Vb)/\rho d>0 \quad (41)$$

$$(-V2'+n\cdot Vt+Vb)/\rho d>0 \quad (42)$$

$$(-(V2+dV)+n\cdot Vt+Vb)/\rho d>0 \quad (43)$$

$$(-(V2'+dV)+n\cdot Vt+Vb)/\rho d>0 \quad (44)$$

The present invention is not limited to the above-described embodiment, and it is needless to mention that it is also possible to add various corrections and modifications to the above embodiment within the scope of the present invention. For example, as the image support, there may be used a photosensitive unit for dry type development, a photosensitive unit for wet type development, or a dielectric drum of an electrostatic printer. While the uni-magnetic one-component toner has been used in the above embodiment, it is also possible to use a magnetic toner in the developing method.

As is clear from the above explanation, according to the present invention, when a development condition that takes into account the charge diffusion of a latent image due to the surface resistance of the image support is set, it becomes possible to prevent the deterioration in resolution due to a charge diffusion. As a result, it is possible to obtain a satisfactory image quality of an original image prepared in high resolution. Further, it is easily possible to adjust the development condition based on the actual using state. As a result, it is possible to prevent the deterioration in image quality due to the lapse of time.

What is claimed is:

1. A developing method for developing an electrostatic latent image formed on an image support, by an inversion development characterized in setting the following relationship:

$$abs(V1)<abs(Vth)$$

where abs (X) represents an absolute value of X, when $$V1=(0.348\ Wr^2-1.161\ Wr+1.0163)Vo,$$

and $$Wr=(1/3.63)\cdot(Rs\cdot Cp/t)^{1/2}\cdot W,$$

where

Cp ($F/m^2$) represents an electrostatic capacity of an image support, Rs (Ω) represents a surface resistance, t (sec) represents a moving time from an electrostatic latent image formation area to a development completion area, Vo (V) represents a potential of a non-image portion of an electrostatic latent image in an image area at the time of forming the electrostatic latent image, Vth (V) represents a surface voltage of the image support when a developing member starts a development at a saturated latent image potential in a solid image, W (m) represents a desired minimum image width, and V1 (V) represents a marginal latent image potential in the minimum image width.

2. The developing method according to claim 1, wherein the developing method sets the following relationship:

$$abs(V1')<abs(Vth)$$

when $$V1'=V1\cdot\exp(-t/(Rv\cdot Cp))$$

where

Rv ($\Omega\cdot m^2$) represents a resistance of the image support in a thickness direction.

3. The developing method according to claim 1, wherein when a toner layer is formed on the surface of the developing member that is applied with a bias voltage Vb (V), and when this developing member is brought into a sliding contact with the image support by a development nip of a predetermined width, values of the following parameters are adjusted to satisfy the following relationship:

$$(-V1+n\cdot Vt+Vb)/\rho d>0$$

where

ρd represents a charge density of the toner layer immediately after the image support passes through the development nip, Vt (V) represents a potential of the toner layer on the developing member, Rr ($\Omega\cdot m^2$) represents a resistance of the developing member, and n represents a ratio (vb/vp) of a rotational speed vb (m/sec) of the developing member to a rotational speed vp (m/sec) of the image support.

4. The developing method according to claim 3, wherein values of the following parameters are adjusted to satisfy the following relationship:

$$(-(V1+dV)+n\cdot Vt+Vb)/\rho d>0$$

where dV (V) represents a variation in the surface potential of the image support due to a friction with the toner when the surface of the image support passes through the development nip.

5. The developing method according to claim 2, wherein when a toner layer is formed on the surface of the developing member that is applied with a bias voltage Vb (V), and when this developing member is brought into a sliding contact with the image support by a development nip of a predetermined width, values of the following parameters are adjusted to satisfy the following relationship:

$$(-V1'+n\cdot Vt+Vb)/\rho d>0$$

where

ρd represents a charge density of the toner layer immediately after the image support passes through the development nip, Vt (V) represents a potential of the toner layer on the developing member, Rr ($\Omega\cdot m^2$) represents a resistance of the developing member, and n represents a ratio (vb/vp) of a rotational speed vb (m/sec) of the developing member to a rotational speed vp (m/sec) of the image support.

6. The developing method according to claim 5, wherein values of the following parameters are adjusted to satisfy the following relationship:

$$(-(V1'+dV)+n\cdot Vt+Vb)/\rho d>0$$

where dV (V) represents a variation in the surface potential of the image support due to a friction with the toner when the surface of the image support passes through the development nip.

7. A developing method for developing an electrostatic latent image formed on an image support, by a positive development, characterzied in setting the following relationship:

$$abs(V2)<abs(Vth)$$

where abs (X) represents an absolute value of X, when $$V2=(-0.348\ Wr^2+1.161\ Wr-0.0163))Vo,$$

and $$Wr=(1/3.63)\cdot(Rs\cdot Cp/t)^{1/2}\cdot W,$$

where

Cp ($F/m^2$) represents an electrostatic capacity of an image support, Rs (Ω) represents a surface resistance, t (sec) represents a moving time from an electrostatic latent image formation area to a development completion area, Vo (V) represents a potential of a non-image portion of an electrostatic latent image in an image area at the time of forming the electrostatic latent image, Vth (V) represents a surface voltage of the image support when a developing member starts a development at a saturated latent image potential in a solid image, W (m) represents a desired minimum image width, and V2 (V) represents a marginal latent image potential in the minimum image width.

8. The developing method according to claim 7, characterized in setting the following relationship:

$$abs(V2')<abs(Vth)$$

when $$V2'=V2\cdot\exp(-t/(Rv\cdot Cp))$$

where

Rv ($\Omega\cdot m^2$) represents a resistance of the image support in a thickness direction.

9. The developing method according to claim 7, wherein when a toner layer is formed on the surface of the developing member that is applied with a bias voltage Vb (V), and when this developing member is brought into a sliding contact with the image support by a development nip of a predetermined width, values of the following parameters are adjusted to satisfy the following relationship:

$$(-V2+n\cdot Vt+Vb)/\rho d>0$$

where

ρd represents a charge density of the toner layer immediately after the image support passes through the development nip, Vt (V) represents a potential of the toner layer on the developing member, Rr ($\Omega\cdot m^2$) represents a resistance of the developing member, and n represents a ratio (vb/vp) of a rotational speed vb (m/sec) of the developing member to a rotational speed vp (m/sec) of the image support.

10. The developing method according to claim 9, wherein values of the following parameters are adjusted to satisfy the following relationship:

$$(-(V2+dV)+n\cdot Vt+Vb)/\rho d>0$$

where dV (V) represents a variation in the surface potential of the image support due to a friction with the toner when the surface of the image support passes through the development nip.

11. The developing method according to claim 8, wherein when a toner layer is formed on the surface of the developing member that is applied with a bias voltage Vb (V), and when this developing member is brought into a sliding contact with the image support by a development nip of a predetermined width, the developing method adjusts values of the following parameters are adjusted to satisfy the following relationship:

$$(-V2'+n\sqrt{Vt+Vb})/\rho d>0$$

where

ρd represents a charge density of the toner layer immediately after the image support passes through the development nip, Vt (V) represents a potential of the toner layer on the developing member, Rr ($\Omega\cdot m^2$) represents a resistance of the developing member, and n represents a ratio (vb/vp) of a rotational speed vb (m/sec) of the developing member to a rotational speed vp (m/sec) of the image support.

12. The developing method according to claim 11, wherein values of the following parameters are adjusted to satisfy the following relationship:

$$(-(V2'+dV)+n\cdot Vt+Vb)/\rho d>0$$

where dV (V) represents a variation in the surface potential of the image support due to a friction with the toner when the surface of the image support passes through the development nip.

13. The developing method according to claim 1 or 7, wherein values of the following parameters are adjusted to satisfy the following relationship:

$$Rr/n\leqq(dt/\in t+dp/\in p)$$

where dp (m) represents a thickness of the photosensitive unit layer of the image support, ∈p (F/m) represents a permittivity thereof, dt (m) represents a thickness of the toner layer before the development, ∈t (F/m) represents a permittivity thereof, Rr ($\Omega\cdot m^2$) represents a resistance of the developing member, and n represents a ratio (vb/vp) of a rotational speed vb (m/sec) of the developing member to a rotational speed vp (m/sec) of the image support.

14. The developing method according to claim 13, wherein when the image support has a resistance layer of Rp ($\Omega\cdot m^2$), values of the following parameters are adjusted to satisfy the following relationship:

$$Rr/n+Rp\leqq(dt/\in t+dp/\in p).$$

15. The developing method according to claim 1 or 7, wherein when a toner layer is formed on the surface of the developing member that is applied with a bias voltage Vb (V), and when this developing member is brought into a sliding contact with the image support by a development nip of a predetermined width, values of the following parameters are adjusted to satisfy the following relationship:

$$-(Vsat+dV)+Vb+n\cdot Vt\geqq\eta\cdot(n\cdot dt)\cdot\rho d(dt/\in t+dp/\in p+Rr/n+Rp)$$

where

Vsat (V) represents a saturated value of a potential of an image portion in the image support, dp (m) represents a thickness of the photosensitive unit layer of the image support, $\in p$ (F/m) represents a permittivity thereof, $\rho d$ (C/m) represents a charge density of the toner layer immediately after the surface of the image support passes through the development nip, dt (m) represents a thickness of the toner layer, $\in t$ (F/m) represents a permittivity thereof, Rr ($\Omega \cdot m^2$) represents a resistance of the developing member, dV (V) represents a variation in the surface potential of the image support due to a friction with the toner when surface of the image support passes through the development nip, n represents a ratio (vb/vp) of a rotational speed vb (m/sec) of the developing member to a rotational speed vp (m/sec) of the image support, and $\eta$ represents a permissible value of development efficiency.

16. The developing method according to claim 15, wherein Pp or dv is omitted or its value is set to zero (0) when it is possible to disregard a variation in the surface potential of the image support due to a friction with the toner at the time of passing through the development nip, or when the image support does not have a resistance layer or when this can be disregarded.

17. The developing method according to claim 1 or 7 aspect, wherein when $\gamma=(1/\eta)-1$, a resistance Rr of the developing member and a resistance Rp of the resistance layer of the image support are set to satisfy the following relationship:

$$Rr/n+Rp \leqq \gamma \cdot (dt/\in t+dp/\in p).$$

18. The developing method according to claim 17, wherein Pp is omitted or its value is set to zero (0) when the image support does not have a resistance layer or when this can be disregarded.

* * * * *